US007828081B2

(12) United States Patent
Reitsma

(10) Patent No.: US 7,828,081 B2
(45) Date of Patent: Nov. 9, 2010

(54) METHOD OF DRILLING A LOSSY FORMATION

(75) Inventor: Donald Gordon Reitsma, Rijswijk (NL)

(73) Assignee: At-Balance Americas LLC, Houston, TX (US)

( * ) Notice: Subject to any disclaimer, the term of this patent is extended or adjusted under 35 U.S.C. 154(b) by 405 days.

(21) Appl. No.: 11/663,118

(22) PCT Filed: Sep. 20, 2005

(86) PCT No.: PCT/EP2005/054696

§ 371 (c)(1),
(2), (4) Date: Oct. 1, 2007

(87) PCT Pub. No.: WO2006/032663

PCT Pub. Date: Mar. 30, 2006

(65) Prior Publication Data

US 2008/0035374 A1 Feb. 14, 2008

(30) Foreign Application Priority Data

Sep. 22, 2004 (EP) ..... 04104601

(51) Int. Cl.
*E21B 21/08* (2006.01)

(52) U.S. Cl. ..... 175/25; 175/38; 175/218

(58) Field of Classification Search ..... 175/25, 175/38, 207, 218, 57
See application file for complete search history.

(56) References Cited

U.S. PATENT DOCUMENTS 2,801,077 A * 7/1957 Howard et al. ..... 166/293
2,946,565 A 7/1960 Williams ..... 255/1.8
4,630,691 A 12/1986 Hooper ..... 175/65

(Continued)

FOREIGN PATENT DOCUMENTS

WO 0079092 12/2000

(Continued)

OTHER PUBLICATIONS

R. Urselmann, et al: Pressured Mud Cap Drilling: Efficient Drilling of High-Pressure Fractured Reservoirs, Mar. 9-11, 1999, SPE/ADE Drilling Conference in Amsterdam, Holland, pp. 1-5.

(Continued)

*Primary Examiner*—David J Bagnell
*Assistant Examiner*—Catherine Loikith
(74) *Attorney, Agent, or Firm*—Osha Liang LLP

(57) ABSTRACT

A method of drilling a bore hole in a fractured formation. A drill pipe is deployed into the borehole, whereby an annular space is formed between the drill pipe and the borehole wall. A drilling fluid is pumped, by means of primary pumps, into the borehole via an internal conduit of the drill pipe and a drill pipe fluid outlet present in the vicinity of a distal end of the drill pipe. The annular space is pressure sealed using a pressure seal such as a rotating head on a BOP. A well control fluid is pumped into the annular space via a well control conduit that fluidly connects the annular space, in a location between the pressure seal and the drill pipe fluid outlet, to a backpressure system. The well control fluid is pressure-balanced against the pressure seal and the backpressure system.

18 Claims, 1 Drawing Sheet

U.S. PATENT DOCUMENTS

| | | | | |
|---|---|---|---|---|
| 6,352,129 | B1 | 3/2002 | Best | 175/25 |
| 6,367,566 | B1 | 4/2002 | Hill | 175/57 |
| 6,374,925 | B1 * | 4/2002 | Elkins et al. | 175/25 |
| 6,755,261 | B2 * | 6/2004 | Koederitz | 175/25 |
| 6,904,981 | B2 * | 6/2005 | van Riet | 175/66 |
| 7,185,719 | B2 | 3/2007 | van Riet | 175/66 |
| 2003/0079912 | A1 | 5/2003 | Leuchtenberg | 175/38 |
| 2003/0098181 | A1 | 5/2003 | Aronstam et al. | 175/65 |
| 2003/0181338 | A1 | 9/2003 | Sweatman et al. | 507/100 |
| 2004/0023815 | A1 * | 2/2004 | Burts, III | 507/200 |
| 2004/0069504 | A1 | 4/2004 | Krueger et al. | 166/387 |
| 2006/0175090 | A1 | 8/2006 | Reitsma et al. | 175/25 |

FOREIGN PATENT DOCUMENTS

| | | |
|---|---|---|
| WO | 02/50398 | 6/2002 |
| WO | 03/071091 | 8/2003 |
| WO | 03071091 | 8/2003 |
| WO | 2005017308 | 2/2005 |

OTHER PUBLICATIONS

Examination Report for British Application No. GB0704505.7, dated Jul. 17, 2008, (1 page).

Substantive Examination Report for Malaysian Application No. PI 20054395, dated Nov. 7, 2008, (3 pages).

First Office Action for Chinese Application No. 200580031832.9, dated Mar. 6, 2009, (5 pages).

International Search Report for PCT Application No. PCT/EP2005/054696, dated Nov. 28, 2005, (3 pages).

Search Report issued in related Application No. GCC/P/2005/5189; dated Feb. 7, 2010 (2 pages).

Examination Report issued in related Application No. GCC/P/2005/5189; dated Feb. 8, 2010 (5 pages).

* cited by examiner

METHOD OF DRILLING A LOSSY FORMATION

PRIORITY CLAIM AND CROSS REFERENCE

The present application is a 35 U.S.C. 371 national stage filing of PCT/EP2005/054696 filed 20 Sep. 2005, which claims benefit of European patent application No. 04104601.2 filed 22 Sep. 2004.

FIELD OF THE INVENTION

The present invention relates to a method of drilling a lossy formation. In the context of the present specification, "lossy formation" is a term used for a formation into which a significant fraction of drilling fluid is lost during the drilling, such as may be the case in a naturally fractured formation or in an abnormally permeable formation.

BACKGROUND OF THE ART

The exploration and production of hydrocarbons from subsurface formations ultimately requires a method to reach and extract the hydrocarbons from the formation. This is typically achieved by drilling a well with a drilling rig. In its simplest form, this constitutes a land-based drilling rig that is used to support and rotate a drill string, comprised of a series of drill tubulars with a drill bit mounted at the end. Furthermore, a pumping system is used to circulate a fluid, comprised of a base fluid, typically water or oil, and various additives down the drill string, the fluid then exits through the rotating drill bit and flows back to surface via the annular space formed between the borehole wall and the drill bit. After being circulated through the bore hole, the drilling fluid normally flows back into a mud handling system, generally comprised of a shaker table, to remove solids, a mud pit and a manual or automatic means for addition of various chemicals or additives to keep the properties of the returned fluid as required for the drilling operation. Once the fluid has been treated, it can be circulated back into the bore hole via re-injection into the top of the drill string with the pumping system.

During drilling operations, the fluid exerts a pressure against the bore hole wall that is mainly built-up of a hydrostatic part, related to the weight of the mud column, and a dynamic part related frictional pressure losses caused by, for instance, the fluid circulation rate or movement of the drill string.

However, in some geological systems, the formation has many natural fractures and/or is extremely permeable. Consequently, (large quantities of) drilling fluid is lost in formation fractures during circulation of drilling fluid.

Sometimes, an effect known as "formation breathing" occurs, whereby the formation returns fluid when pumping of fresh drilling fluid into the hole is interrupted, mostly of a different density than the original drilling fluid. This results in kicks, a well control problem, often resulting in a lost hole section or well. During the planning phase of wells, the expectation of severe formation breathing may result in cancelling the well based on risk analysis.

A quantity of the drilling fluid may, however, remain behind in the formation.

One way of coping with such loss of circulation fluid is to accept the losses and drill ahead. This is known as "blind drilling", "floating drilling", "mudcap drilling", or "closed hole circulation drilling". A clean and preferably cheap drilling fluid would be pumped down the drill string, to be lost into the formation. To control the reservoir, overbalanced mud would be pumped into the annular space at a rate that is higher than the hydrocarbon migration rate. The well control capabilities are quite limited and for safety reasons the application of "blind drilling" has thus been limited to low pressured and/or non-sour formations.

SUMMARY OF THE PRESENT INVENTION

The present invention is directed to a method of drilling a borehole in a lossy formation, comprising the steps of deploying a drill pipe into the borehole, whereby an annular space is formed between the drill pipe and the borehole wall;

pumping a drilling fluid into the borehole via an internal conduit of the drill pipe and a drill pipe fluid outlet present in the vicinity of a distal end of the drill pipe;

pressure sealing the annular space using a pressure seal;

pumping a well control fluid into the annular space via a well control conduit that fluidly connects the annular space in a location between the pressure seal and the drill pipe fluid outlet, to a backpressure system;

pressure-balancing the well control fluid against the pressure seal and the backpressure system.

The present invention is capable of supplying a well control fluid directly into the annular space below the pressure seal, thereby ensuring that the pressure can be balanced against the pressure seal and back pressure system. The down hole pressure is the combined result of hydrostatic pressure due to the column of the well control fluid, and the pressure exerted on the well control fluid by the pressure seal and the back pressure system.

Pressure-balancing of the well control fluid against the pressure seal and the backpressure system can be achieved by continued pumping of drilling fluid into the borehole via the internal conduit in the drill pipe. Such drilling fluid will then "push up" against the well control fluid, so that hardly any well control fluid needs to be lost into the fractures due to overbalance.

Of course, the drilling fluid will be lost to the formation, which must be the case in order to keep a certain flow rate through the drill pipe needed for hole cleaning, bit cooling, and optional measurement while drilling (MWD) sub operation.

Due to the pressure-balancing against the pressure seal and back pressure system, it is now also possible to use essentially identical fluids as the drilling fluid and the well control fluid during "blind drilling".

The pressure seal may be provided in the form of a rotating head or a rotating blow out preventor (rotating BOP).

In one aspect, the invention is capable of controlling the annular pressure during "blind drilling" by actively controlling the pressure-balancing against the pressure seal and backpressure system, for instance by utilising the back pressure system to create a controlled variable backpressure at the annular space exit at surface. This may include allowing pumped well control fluid to discharge over a variable flow restriction and actively controlling a pressure drop over the flow restriction.

Preferably, the pressure-balancing is automatically controlled. Automatic controlling may include the calculating a predicted down hole pressure using a model, comparing the predicted down hole pressure to a desired down hole pressure, and utilizing the differential between the calculated and desired pressures to control the pressure-balancing, all by means of a programmable pressure monitoring and control system.

In one embodiment, the present invention utilizes information related to the bore hole, drilling process, drill rig and drilling fluid as inputs to a model to predict the downhole pressure. The present invention may further utilize actual downhole pressure to calibrate the model and modify input parameters to more closely correlate predicted downhole pressures to measured downhole pressures.

It will be appreciated that the use of backpressure to control annular pressure is more responsive to sudden changes in formation pore pressure.

BRIEF DESCRIPTION OF THE DRAWINGS

A better understanding of the present invention may be obtained by referencing the following drawing in conjunction with the Detailed Description of the Preferred Embodiment, in which.

DETAILED DESCRIPTION OF THE INVENTION

Figure 1:
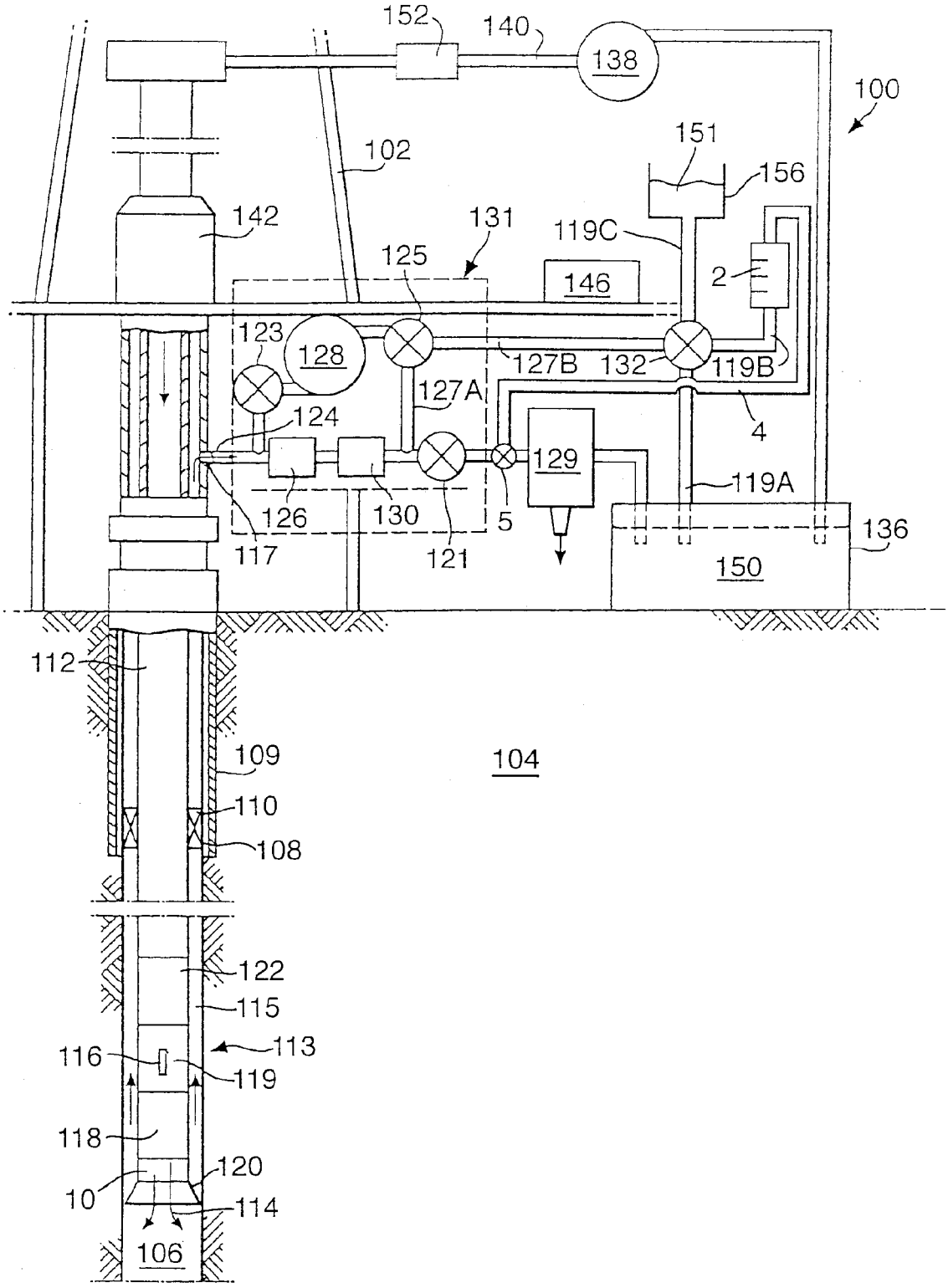
FIG. 1 is a schematic view of an apparatus for performing the preferred method of the invention.

The present invention is intended to achieve Dynamic Annular Pressure Control (DAPC) of a bore hole during drilling, completion and intervention operations, in particular involving a lossy formation such as a naturally fractured formation or an abnormal highly permeable formation.

FIG. 1 is a schematic view depicting a surface drilling system 100 employing the current invention. It will be appreciated that an offshore drilling system may likewise employ the current invention. The drilling system 100 is shown as being comprised of a drilling rig 102 that is used to support drilling operations. Many of the components used on a rig, such as the kelly, power tongs, slips, draw works and other equipment are not shown for ease of depiction. The rig 102 is used to support drilling and exploration operations in a formation 104. A borehole 106 has already been partially drilled, using a drill pipe 112 that has been deployed into the bore hole 106. An annular space 115 is formed between the drill pipe 112 and the borehole wall.

The drill pipe 112 will typically comprise of a string of pipe sections, generally referred to as a drill string, which pipe sections are typically screw joined.

The drill pipe 112 is provided with a, generally longitudinal, internal conduit that fluidly connects a drill pipe fluid inlet present in the vicinity of a proximal end of the drill pipe at surface with a drill pipe fluid outlet 114 present in the vicinity of a distal end of the drill pipe in the bore hole 106.

The drill pipe 112 supports a bottom hole assembly (BHA) 113 that typically includes a drill bit 120, a MWD/LWD sensor suite 119, including a pressure transducer 116 to determine annular pressure being the pressure of the fluid contained in the annular space 115, a check valve 10 to prevent backflow of fluid from the annular space 115. It may also include a telemetry package 122 that is used to transmit pressure data and/or MWD/LWD data and/or drilling information, to be received at the surface. It may also include a mud motor 118.

The drill pipe fluid outlet 114 is typically provided in the form of one or more flushing outlets in the drill bit 120 but this is not essential for the present invention.

In the example, a casing 108 is already set and cemented 109 into place. In the preferred embodiment, a casing shutoff mechanism, or downhole deployment valve, 110 is installed in the casing 108 to optionally shut-off the annular space 115 and effectively act as a valve to shut off a so-called open hole section of the bore hole 106 situated below the casing 108, when the entire drill pipe 112 is located above the valve 110.

The drilling process requires the use of a drilling fluid 150, which is stored in reservoir 136. The drilling fluid can be any drilling fluid conventially used on a rig site, including mud or brine. The reservoir 136 is in fluid communication with one or more primary drilling fluid pumps 138 which pump the drilling fluid through a conduit 140. Conduit 140 is connected to the last joint of the drill string 112 to establish access for fluid from conduit 140 into the internal conduit of the drill pipe 112 via the drill pipe fluid inlet. The drill pipe 112 passes through a rotating control head 142 on top of a blow out preventer (BOP). The rotating control head on top of the BOP forms, when activated, a pressure seal around the drill pipe 112, isolating the pressure in the annular space 115, but still permitting drill pipe rotation and reciprocation.

A backpressure system 131 is provided, to enable maintaining an adjustable backpressure during the entire drilling and completing process but in particular during drilling into a lossy formation. The ability to do so is a significant improvement over prior art "blind drilling".

The back pressure system 131 comprises a conduit 124 in fluid communication with the annular space 115 in a location 117 between the pressure seal 142 and the drill pipe fluid outlet 114. An optional flow meter 126 is included in conduit 124, which may be a mass-balance type or other preferably high-resolution flow meter. Conduit 124 is provided with a variable flow restrictive device, such as a wear resistant choke 130.

The choke 130 may be provided in the form of a choke manifold. It will be appreciated that there exist chokes designed to operate in an environment where the drilling fluid 150 contains substantial drill cuttings and other solids. Choke 130 is one such type and is further capable of operating at variable pressures, flowrates and through multiple duty cycles.

The choke 130 discharges to a valve 5. Valve 5 allows drilling fluid returning from the annular space 115 to be directed through a drilling fluid recovery system 129 to reservoir 136, or to be directed to an auxiliary reservoir 2 via a conduit 4. The drilling fluid recovery system 129 is designed to remove excess gas contaminates, including cuttings, from the drilling fluid 150, and will typically include solids separation equipment such as a shale shaker, and an optional degasser. After passing solids separation equipment 129, the drilling fluid 150 is returned to reservoir 136.

Auxiliary reservoir 2 can be provided in addition to the reservoir 136, to function as a trip tank. A trip tank is normally used on a rig to monitor drilling fluid gains and losses during tripping operations. In the present invention, this functionality can be maintained.

Instead of the trip tank 2, or additionally to the trip tank 2, a well control fluid reservoir 156 may also be provided, to be filled with a specific well control fluid 151, that is not (yet) present in any of the other reservoirs. This could be a fluid of the same or similar type as a drilling fluid, such as mud or brine, but also water or sea water might be employed.

The back pressure system 131 is further provided with a back pressure pump 128, which in the present invention can function to pump the well control fluid directly into the annular space 115 via conduit 124. A high-pressure end of the back pressure pump 128 discharges into conduit 124 between the annular space 115 and the choke 130. A selection valve 125 is provided for establishing a fluid connection between either conduit 127A or 127B on one hand and a low-pressure end of backpressure pump 128 on the other hand. Herewith it can be selected whether the back pressure pump 128 is fed using fluid directly discharged from choke 130 (in which case valve 121 may be closed), or from another fluid source. The other fluid source is selectable using a selection valve 132, which discharges into conduit 127B, fluidly connecting either reservoir 136 via conduit 119A, trip tank 2 via conduit 119B, or well control fluid reservoir 156 via conduit 119C, to the low-pressure end of backpressure pump 128. Selection valve 125 and or selection valve 132 may be provided in the form of a manifold of valves.

A valve 123 is provided to be able to selectively isolate the high-pressure end of back pressure pump 128 from conduit 124 in order to protect the back pressure pump 128 when it is not activated.

The preferred embodiment of the present invention further includes a flow meter 152 in conduit 140 to measure the amount of drilling fluid being pumped into the bore hole 106. Alternatively, the volume can be calculated from the rig pump stroke count and volume.

An alternative embodiment of the system (not shown) could have an additional two way valve, or a selection valve manifold, placed downstream of the primary pump 138 in conduit 140. This valve would offer the possibility of allowing drilling fluid from the primary drilling fluid pump 138 to be diverted from conduit 140 to conduit 124 located between the annular space 115 and the choke 130. By maintaining pump action of primary pump 138, sufficient flow through the choke 130 is ensured, to control backpressure without the need of utilizing a separate back pressure pump 128.

The back pressure system 131 is operably connected to a programmable pressure monitoring and control system 146, which is capable of receiving drilling operational data and controlling the back pressure system 131 and/or primary drilling fluid pump 138 in response to the drilling operational data.

Further details of the drilling system 100 and in particular of the programmable pressure monitoring and control system 146, and its operation in relation to the back pressure system 131 and the drilling system 100, can be found in International publication WO 2003/071091 (corrected version) which is herewith incorporated by reference.

Normal operation of the drilling system 100 described above, whereby drilling fluid is mostly circulated into the bore hole 106 via the internal conduit of the drill pipe 112 and subsequently out of the bore hole 106 via conduit 124, is fully illucidated in International publication WO 2003/071091 (corrected version), introduced hereinbefore.

The drilling fluid 150 is pumped down through the drill pipe 112 and the BHA 113 and exits the drilling fluid outlet 114, where it circulates the cuttings away from the bit 120 and returns them up annular space 115 first via the open hole section and subsequently via the cased section of the bore hole 106. The drilling fluid 150 returns to the surface and goes through the side outlet 117 below the rotating head 142 into conduit 124.

Thereafter the drilling fluid 150 proceeds to what is generally referred to as the backpressure system 131. It will be appreciated that, for instance by utilizing the flow meters 126 and 152, monitoring the flow in and out of the bore hole 106 and the volume pumped by the backpressure pump 128, and further taking into account all substances moving in and out of the annular space 115 at surface, the operator or the system is readily able to determine the amount of drilling fluid 150 being lost to the formation, or conversely, the amount of formation fluid leaking to the borehole 106.

In short, when there is sufficient circulation of drilling fluid 150 through drill pipe 112 and annular space 115, the choke 130 imposes a pressure drop in the return fluid flow, by virtue of which a back pressure is maintained in annular space 115. The magnitude of the back pressure is controlled by controlling the flow resistance in the choke 130.

When the flow rate of drilling fluid from the annular space 115 is so low that the choke 130 can not conveniently be regulated into imposing the desired back pressure, the back pressure pump 128 is activated to pump drilling fluid into conduit 124 (valve 123 would be opened) and thereby to ensure a sufficient fluid flow through the choke 130 to impose the desired back pressure to maintain the desired down hole pressure. Typically, the valve 125 may be selected to either conduit 119A or conduit 119B.

When, however, a significant quantity of drilling fluid is lost into the formation, such as might be the case when the bore hole 106 proceeds into a naturally fractured and/or extremely permeable formation, the fluid level in the annular space 115 may drop. When back pressure pump 128 is activated, the fluid level will be restored with fluid pumped into conduit 124 of which at least part will flow directly into the annular space 115. Valve 121 may be closed during the filling of the annular space with the fluid.

Continued operation of back pressure pump 128 after the fluid level in the annular space 115 has been restored and after valve 121 has been opened, ensures that a sufficient flow rate through choke 130 can be maintained such that even in cases where a large quantity of drilling fluid is lost to the formation the back pressure can be actively controlled by adjusting at least the flow restriction imposed by choke 130.

The fluid pumped into the annular space 115 via conduit 124 is referred to as "well control fluid", to distinguish it from "drilling fluid" which is pumped into the bore hole 106 via the drill pipe 112. The well control fluid may be identical to the drilling fluid 150, in which case the valve 125 may typically be selected to connect the back pressure pump 128 to conduit 119A or 119B. In mud cap drilling methods of the prior art, it was not possible to continue drilling in fractured formations using the same fluid as the drilling fluid for well control fluid.

Alternatively, valve 125 may be selected to connect the back pressure pump 128 to conduit 119C, in which case the well control fluid 151 can be a fluid different from the drilling fluid 150. In that case, the invention offers the advantage of increased bottom hole pressure control by having the possiblity to actively control back pressure.

An advantage of the invention is that the density of the well control fluid 151 can be selected to be at- or underbalanced against the lowest pressure of reservoir fluids. The pressure-balancing against the pressure seal 142 and the back pressure system 131 allows for an additional contribution to the bottom hole pressure.

Pressure-balancing the well control fluid against the pressure seal 142 and back pressure system 131 can be achieved by continued pumping of drilling fluid 150 into the drill pipe 112. The pressure-balancing contributes to avoid pumping well control fluid into the formation. Because the drilling fluid 150, that is pumped into the bore hole via the drill pipe, now pushes up against the well control fluid (which gives the pressure-balancing contribution to the down hole pressure), hardly any well control fluid needs to be lost into the fractures due to overbalance.

The back pressure system 131 can be actively controlled, either via an intermediate operator or the programmable pressure monitoring and control system 146, in order to control the bottom hole pressure.

International publication WO 2003/071091 (corrected version), introduced hereinabove, also makes reference to and describes a hydraulic model. In the present invention, that hydraulic model or an alternative embodiment thereof is used to calculate a predicted down hole pressure, compare the predicted down hole pressure to a desired down hole pressure, and utilize the differential between the calculated and desired pressures to control the pressure-balancing. This is all included in the programmable pressure monitoring and control system 146.

The method of the invention can be applied in on-shore as well as off-shore operations.

What is claimed is:

1. A method of drilling a bore hole in a lossy formation, comprising the steps of deploying a drill pipe into the borehole, whereby an annular space is formed between the drill pipe and the borehole wall;

pumping a drilling fluid into the bore hole via an internal conduit of the drill pipe and a drill pipe fluid outlet present in the vicinity of a distal end of the drill pipe;

pressure sealing the annular space using a pressure seal;

pumping a well control fluid into the annular space in the lossy formation via a well control conduit that fluidly connects the annular space in a location between the pressure seal and the drill pipe fluid outlet, to a back pressure system; and pressure-balancing the well control fluid against the pressure seal and the backpressure system.

2. The method of claim 1, wherein the pressure-balancing is actively controlled.

3. The method of claim 2, wherein actively controlling of the pressure-balancing includes allowing pumped well control fluid to discharge in the back pressure system over a variable flow restriction and controlling a pressure drop over the flow restriction.

4. The method of claim 3, wherein actively controlling the pressure-balancing includes automatically controlling the pressure-balancing by means of automatic control means controlling the back pressure system.

5. The method of claim 4, wherein automatically controlling the pressure-balancing includes calculating a predicted down hole pressure using a model, comparing the predicted down hole pressure to a desired down hole pressure, and utilizing the differential between the calculated and desired pressures to control the pressure-balancing, all by means of a programmable pressure monitoring and control system.

6. The method of claim 2, wherein actively controlling the pressure-balancing includes automatically controlling the pressure-balancing by means of automatic control means controlling the back pressure system.

7. The method of claim 6, wherein automatically controlling the pressure-balancing includes calculating a predicted down hole pressure using a model, comparing the predicted down hole pressure to a desired down hole pressure, and utilizing the differential between the calculated and desired pressures to control the pressure-balancing, all by means of a programmable pressure monitoring and control system.

8. The method of claim 1, wherein the well control fluid is selected to be essentially identical to the drilling fluid.

9. The method of claim 8, wherein the well control fluid and the drilling fluid are pumped into the bore hole using the same pump means for generating a pumped stream of a selected fluid and dividing the pumped stream of the selected fluid into a well control stream and a drilling fluid and feeding the drilling fluid to the internal conduit of the drill pipe and feeding the well control fluid to the well control conduit.

10. A method of producing hydrocarbons from a subsurface formation, comprising extracting hydrocarbons from the formation using a well drilled according to a method wherein a drill pipe is deployed into a borehole, whereby an annular space is formed between the drill pipe and the borehole wall; a drilling fluid is pumped into the bore hole via an internal conduit of the drill pipe and a drill pipe fluid outlet present in the vicinity of a distal end of the drill pipe; the annular space is pressure-sealed using a pressure seal; and a well control fluid is pumped into the annular space in the lossy formation via a well control conduit that fluidly connects the annular space in a location between the pressure seal and the drill pipe fluid outlet, to a back-pressure system, and pressured balanced against the pressure seal and backpressure system.

11. The method of claim 10, wherein the pressure-balancing is actively controlled.

12. The method of claim 11, wherein actively controlling of the pressure-balancing includes allowing pumped well control fluid to discharge in the back pressure system over a variable flow restriction and controlling a pressure drop over the flow restriction.

13. The method of claim 11, wherein actively controlling the pressure-balancing includes automatically controlling the pressure-balancing by means of automatic control means controlling the back pressure system.

14. The method of claim 13, wherein automatically controlling the pressure-balancing includes calculating a predicted down hole pressure using a model, comparing the predicted down hole pressure to a desired down hole pressure, and utilizing the differential between the calculated and desired pressures to control the pressure-balancing, all by means of a programmable pressure monitoring and control system.

15. The method of claim 10, wherein the well control fluid is selected to be essentially identical to the drilling fluid.

16. The method of claim 15, wherein the well control fluid and the drilling fluid are pumped into the bore hole using the same pump means for generating a pumped stream of a selected fluid and dividing the pumped stream of the selected fluid into a well control stream and a drilling fluid and feeding the drilling fluid to the internal conduit of the drill pipe and feeding the well control fluid to the well control conduit.

17. The method of claim 15, wherein actively controlling the pressure-balancing includes automatically controlling the pressure-balancing by means of automatic control means controlling the back pressure system.

18. The method of claim 17, wherein automatically controlling the pressure-balancing includes calculating a predicted down hole pressure using a model, comparing the predicted down hole pressure to a desired down hole pressure, and utilizing the differential between the calculated and desired pressures to control the pressure-balancing, all by means of a programmable pressure monitoring and control system.

* * * * *